United States Patent [19]

Hofmann, Jr.

[11] 4,089,623

[45] May 16, 1978

[54] COMPRESSOR INTAKE CONTROL

[75] Inventor: Rudolf Hofmann, Jr., Diedenbergen, Germany

[73] Assignee: Sullair Schraubenkompressoren GmbH, Munich, Germany

[21] Appl. No.: 645,435

[22] Filed: Dec. 30, 1975

[30] Foreign Application Priority Data

Jan. 2, 1975 Germany ..... 2500040

[51] Int. Cl.[2] ..... F04B 49/00

[52] U.S. Cl. ..... 417/295

[58] Field of Search ..... 417/295, 302, 313, 26, 417/28, 303; 418/97, 84

[56] References Cited

U.S. PATENT DOCUMENTS

| | | | |
|---|---|---|---|
| 2,556,623 | 6/1951 | Lipkau | 417/295 |
| 2,613,026 | 10/1952 | Banks | 417/295 |
| 3,054,552 | 9/1962 | Doubleday et al. | 417/295 |
| 3,168,236 | 2/1965 | Lamberton et al. | 417/295 |
| 3,632,231 | 1/1972 | Bloom | 417/295 |
| 3,775,030 | 11/1973 | Wanner | 417/388 |
| 3,860,363 | 1/1975 | Silvern et al. | 417/26 X |
| 3,923,425 | 12/1975 | Porter et al. | 417/507 X |
| 3,961,862 | 6/1976 | Edstrom et al. | 418/87 X |
| 3,969,041 | 7/1976 | Thausing et al. | 417/295 |
| 3,994,358 | 11/1976 | Smitley | 417/295 X |

*Primary Examiner*—William L. Freeh
*Assistant Examiner*—Edward Look
*Attorney, Agent, or Firm*—Wegner, Stellman, McCord, Wiles & Wood

[57] ABSTRACT

A compressor intake throttle valve is positioned in accordance with the inlet suction of the compressor, regulating the volume of inlet air in accordance with the load on the compressor. A relief valve connected with the compressor outlet opens when the compressor outlet pressure exceeds a set value and vents compressed air to the compressor intake passage at a point between the throttle valve and the compressor inlet, closing the throttle valve.

5 Claims, 1 Drawing Figure

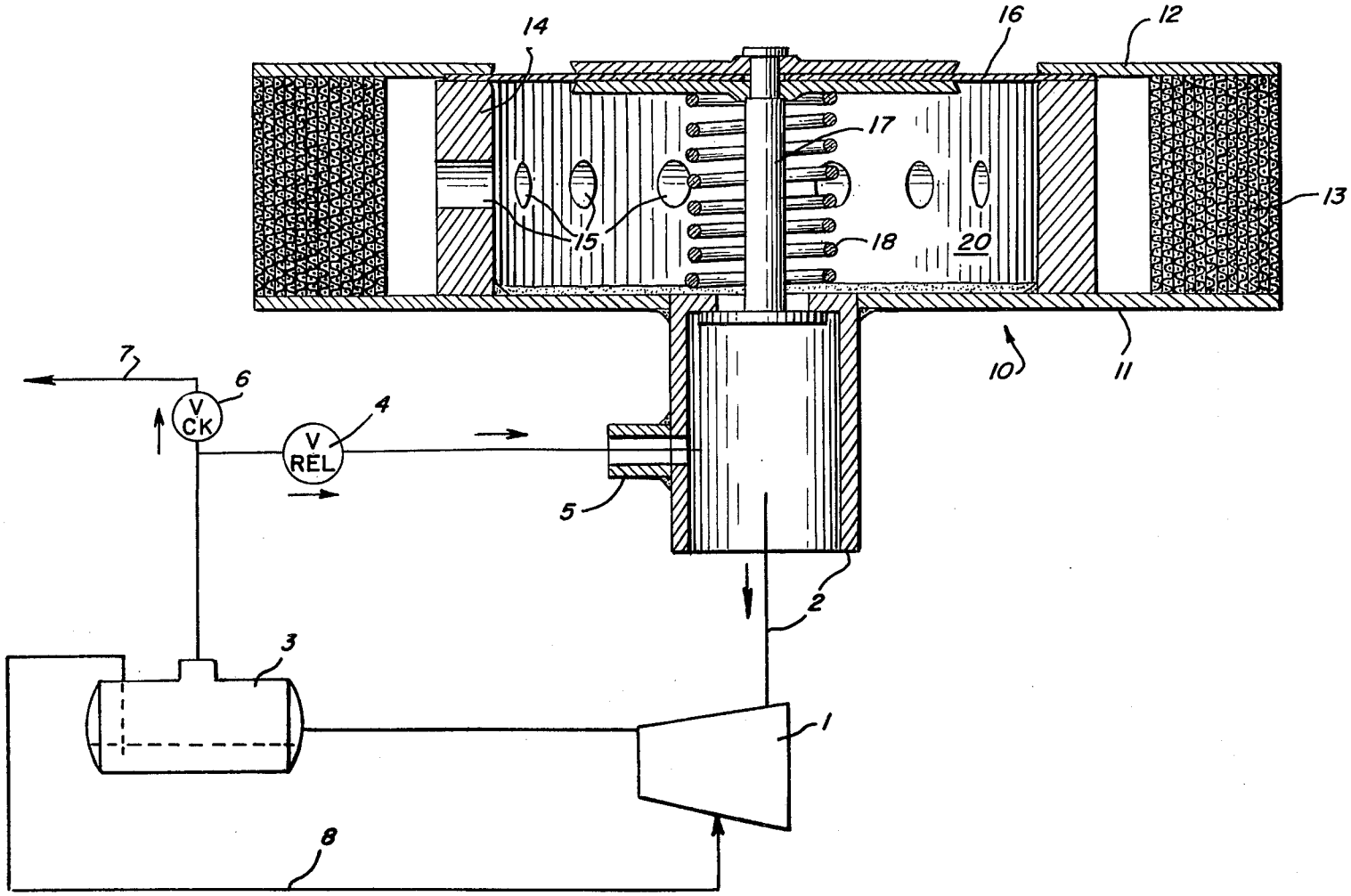
13
12
11
16
10
20
17
18
2
1
5
15
14
4
V
REL
3
8
6
V
CK
7

COMPRESSOR INTAKE CONTROL

This invention relates to throttle and relief valves for an air compressor.

A prior compressor has a butterfly throttle valve actuated through a pneumatic control by compressor outlet pressure to vary the volume of the intake air. A pressure switch connected with the compressor outlet operates solenoid valves to close the throttle valve and to vent the outlet in the event line pressure is excessive. An air operated valve in the cooling oil line closes when the compressor outlet is vented, preventing flooding of the compressor. Multiple valves and controls add to the initial cost of the system and contribute to service problems.

It is an object of this invention to simplify the throttle and relief valves of a compressor.

One feature of the invention is that the compressor has an intake flow control including means defining an intake flow passage to the compressor inlet, a movable throttle valve in the flow passage and means for positioning the throttle valve in accordance with the flow of air into the compressor. More particularly, the intake flow passage has a restricted inlet from the atmosphere so that a pressure less than atmospheric is established in the flow passage and the throttle valve is operated by a movable diaphragm responsive to the differential between the intake and atmospheric pressure.

Another feature of the invention is the provision of a relief valve connected from the outlet of the compressor to the inlet at a point between the intake throttle valve and the compressor inlet so that when compressed air is vented from the compressor outlet to the inlet, the intake valve is closed.

Further features and advantages of the invention will readily be apparent from the following specification and from the drawing which shows the intake valve in cross-section and the compressor and relief valve diagrammatically.

Compressor 1 sucks in air through an intake pipe 2 and delivers compressed air into a pressure tank 3. A relief valve 4 is connected to intake pipe 2 at 5. Compressed air is delivered to utilization apparatus (not shown) through check valve 6 and line 7. Oil for cooling and lubricating the compressor is separated from the air in tank 3 and returned to the compressor under air pressure through line 8.

Intake pipe 2 is connected with an intake valve and filter assembly 10. A pair of annular discs 11 and 12 define a flat, disc-shaped housing with a filter 13 disposed between the discs at the outer periphery thereof. Inside filter 13 an annular wall 14 extends between discs 11, 12 and is provided with air passages 15.

A diaphragm 16 is fixedly clamped between wall 14 and the upper annular disc 12 by means of screws or bolts (not shown). Valve 17 attached to diaphragm 16 is guided in an appropriately shaped valve seat in the opposite housing wall 11. Compression spring 18 extends between the diaphragm disc 16 and housing wall 11, urging valve 17 to closed position. Intake pipe 2 extends from the valve seat in housing wall 11 to the inlet of compressor 1 and is provided with the connection to relief valve 4.

The space 20 defined by the lower housing wall 11, annular wall 14 and diaphragm 16 is in communication with the filter 13 and the ambient atmosphere, through one or more passages 15. In the position of valve body 12 as shown the connection between space 20 and intake pipe 2 is blocked.

During operation of the compressor 1, compressed air is delivered into pressure tank 3 and compressed air is withdrawn therefrom by utilization apparatus so that the maximum pressure within pressure tank 3 is not reached. The suction existing in intake pipe 2 is effective to hold valve 17 in an open position against the force of spring 18, so that air is drawn in through filter 13. The passages 15 through wall 14 constitute a flow restricting passage with a cross-sectional area selected so that a sufficiently high value of suction will exist within the space 20 to draw diaphragm 16, which has the atmospheric pressure applied to the outside thereof, inwardly against the force of spring 18, so that valve body 17 clears and opens the connection to intake pipe 2.

If the utilization units do not draw any compressed air from pressure tank 3 while the compressor 1 continues to operate, the relief valve 4 will open when the maximum tank pressure is exceeded, and air under pressure will flow through connection 5 downstream of the valve 17 into the intake pipe 2. Thereby the suction maintained through flow restricting passage 15 is lessened causing throttle valve 17 to close. In this operating condition, the compressor sucks in the air which flows from pressure tank 3, and it redelivers such air back into the pressure tank. Operation of the compressor in this state can be maintained so that additional control means can be eliminated. The relief valve is effective to build up a pressure in the intake pipe, which pressure counteracts the pressure of oil injection, and, moveover, as the inlet valve 17 is closed, the possibility of oil escaping through the intake filter is precluded.

I claim:

1. In combination with an air compressor having an inlet and an outlet, an intake flow control comprising:

an intake flow passage connecting the compressor inlet with the ambient atmosphere;

a movable throttle valve adapted to seal against a valve seat in said intake flow passage when moved to a closed position to prevent communication between the compressor inlet downstream and the ambient atmosphere upstream;

means for biasing said throttle valve toward the closed position against said valve seat;

means responsive to the difference between atmospheric pressure and the pressure in said flow passage for positioning said throttle valve, said throttle valve being moved to an open position when atmospheric pressure exceeds the pressure in said intake flow passage by an amount sufficient to overcome said biasing means;

a relief line connected between the compressor outlet and said intake flow passage at a point between said throttle valve and the compressor inlet; and a relief valve in said relief line for delivering compressed air from the compressor outlet to said intake flow passage when the pressure at the compressor outlet exceeds the relief valve setting so that the pressure in said intake flow passage downstream of said throttle valve increases and said throttle valve is closed.

2. The intake flow control of claim 1 wherein said intake flow passage is defined by a pair of spaced apart plates with a peripheral air inlet open to the ambient atmosphere an annular wall extending between said plates defining a central space and having a plurality of passages therethrough with a cross-sectional area sufficiently small to create a flow restriction producing a pressure within said central space which is less than atmospheric pressure, and an intake conduit providing communication between said central space and the compressor inlet through one of said plates, said responsive positioning means being a diaphragm forming a part of the other of said plates, said diaphragm separating said central space from the ambient atmosphere, said valve seat being formed in said intake conduit, said throttle valve having at one end a stem connected to said diaphragm extending through said central space into said intake conduit and a valve head at the other end within said intake conduit between said valve seat and said relief line such that atmospheric pressure on said diaphragm acts against said biasing means to urge the throttle valve head away from said valve seat, whereby said throttle valve is opened when the difference between atmospheric pressure acting on one side of said diaphragm and the pressure in said flow passage acting on the other side on said diaphragm and said throttle valve is sufficient to overcome said biasing means, and is closed to prevent communication between said central space and the compressor inlet through said intake conduit when the pressure difference is insufficient.

3. The intake flow control of claim 2 wherein said biasing means is a spring biasing said throttle valve toward a closed position on its valve seat.

4. The intake flow control of claim 2 further including an annular air filter disposed outboard of said annular wall between the peripheries of said plates.

5. The intake flow control of claim 1 wherein said flow passage has a restricted inlet from the atmosphere whereby a pressure less than atmospheric is established in said flow passage, and said positioning means including a diaphragm connected to said throttle valve responsive to the difference between atmospheric and the flow passage pressure .

* * * * *